US007073217B2

(12) United States Patent
Stevenson

(10) Patent No.: US 7,073,217 B2
(45) Date of Patent: Jul. 11, 2006

(54) FOLDING MULTIMODAL SOFA BEDS FOR RECREATIONAL VEHICLES

(76) Inventor: Edward F. Stevenson, 2309 Edward Ave., So. El Monte, CA (US) 91733

( * ) Notice: Subject to any disclaimer, the term of this patent is extended or adjusted under 35 U.S.C. 154(b) by 0 days.

(21) Appl. No.: 10/996,698

(22) Filed: Nov. 24, 2004

(65) Prior Publication Data

US 2006/0107458 A1 May 25, 2006

(51) Int. Cl.
*A47C 17/64* (2006.01)

(52) U.S. Cl. ..... 5/118; 5/37.1; 5/43

(58) Field of Classification Search ..... 5/37.1, 5/38, 42.1, 43, 45, 118; 297/116, 92, 94, 297/101, 111
See application file for complete search history.

(56) References Cited

U.S. PATENT DOCUMENTS

| | | | | |
|---|---|---|---|---|
| 996,644 | A * | 7/1911 | Hohlfeld | 297/116 |
| 2,605,912 | A | 8/1952 | Small et al. | |
| 2,953,792 | A | 9/1960 | Fleischer | |
| 3,179,462 | A | 4/1965 | Hagen | |
| 3,675,965 | A | 7/1972 | Burdett | |
| 3,734,558 | A | 5/1973 | Stead | |
| 3,877,086 | A | 4/1975 | Bue et al. | |
| 3,910,630 | A * | 10/1975 | Runyon et al. | 297/63 |
| 3,961,716 | A | 6/1976 | Renaud | |
| 3,984,140 | A | 10/1976 | Robertson | |
| 4,005,898 | A | 2/1977 | Way | |
| 4,110,855 | A | 9/1978 | Acker | |
| 4,625,347 | A | 12/1986 | McElmurry et al. | |
| 4,854,631 | A | 8/1989 | Laursen | |
| 5,314,200 | A | 5/1994 | Phillips | |
| 5,755,478 | A | 5/1998 | Kamiya et al. | |
| 5,787,522 | A | 8/1998 | Swihart | |
| 6,163,900 | A * | 12/2000 | Stevenson | 5/118 |

FOREIGN PATENT DOCUMENTS

GB 2103551 A 2/1983

* cited by examiner

*Primary Examiner*—Suzanne Dino Barrett
*Assistant Examiner*—Fredrick Conley
(74) *Attorney, Agent, or Firm*—Christie, Parker & Hale, LLP

(57) ABSTRACT

A folding multimodal sofa bed for use with recreational vehicles. The folding multimodal sofa bed has a front facing backrest section, an intermediate section, and a rear facing backrest section. A front pair of rollover arms connect the front facing backrest section to the intermediate section, and rear pair of rollover arms connect the rear facing backrest section to the intermediate section. The rollover arms permit rollover of the front or rear facing backrest section from horizontal bed mode, wherein the front and rear facing backrest section are adjacent to the horizontal intermediate section, to either a front or rear facing sofa mode, wherein the front or rear facing section is pivoted to be above the top surface of the intermediate section in a generally vertical, slanted back orientation facing forwardly or rearwardly.

10 Claims, 6 Drawing Sheets

FOLDING MULTIMODAL SOFA BEDS FOR RECREATIONAL VEHICLES

BACKGROUND

The invention relates to the field of furniture for recreational vehicles including self-contained motorized vehicles in addition to trailers hauled by motor vehicles, and more particularly to a folding multimodal sofa bed for recreational vehicles that can be converted from a bed to a sofa facing in either of two opposite directions when deployed as a sofa, and when not in use as a bed or sofa can be stowed out of way to maximize the useable floor space of the recreational vehicle.

In the last few years, a style of recreational vehicles and trailers (hereinafter "RVs") having an extra wide rear door or doors that swing open or drop down to permit dune buggies, two, three and four-wheel motorcraft, and other items to be carried inside the RV, or at least a rear section of an RV, during travel, and then unloaded, has become more popular. In some of these RVs, a swing down rear door will form a floor of a deployable patio area (e.g. a screened in room) that extends over the swing rear down door.

After the RV user arrives at the site, the wide door or doors of the RV are opened and the carried items can be moved out of the RV. In order to maximize the space inside of the RV available for storing these various items, tables, seating, bedding, and the like are best moved out of the way and stowed away. In order to set up the tables, seating, beds, etc., after the carried items are moved out of the RV, the user will typically need to spend a considerable amount of time and effort to remove the tables, seating, beds, etc., from their stowed location in the RV and setting them up. When the user is ready to go, or wishes to store items back in the RV, he or she will have to reverse the process.

In order to maximize the useable space in the RV after the items being carried are removed from the rear of the RV, and in order to save set up and take down time, there have been developed various folding RV furniture, including the invention disclosed in the inventor's U.S. Pat. No. 6,163,900. The inventor's folding RV furniture of U.S. Pat. No. 6,163,900 folds down from a sidewall of the RV. When not in use, the furniture can be folded back up against the wall and minimally extends into the space of the RV when not in use. Recently, there has been developed a system that uses rails mounted on the inside side walls of an RV to raise and lower furniture, e.g., beds, from a ceiling of the RV.

In the case of RVs that include a patio area formed in part from the drop down rear gate, may users of RV like to set up furniture on the patio area so that they can sit down and look straight out of their RV and enjoy nature. However, this requires that extra furniture be carried, stored and then deployed. It would be beneficial to have a multimodal sofa bed that permits a user to set up a sofa that faces either outside the back of the RV or inwardly into the RV. Moreover, it would be beneficial to have RV furniture that does not need to occupy wall space when not in use.

DETAILED DESCRIPTION OF THE INVENTION

The present invention will now be described more fully with reference to the accompanying drawings, in which exemplary embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to those skilled in the art.

Figure 1:
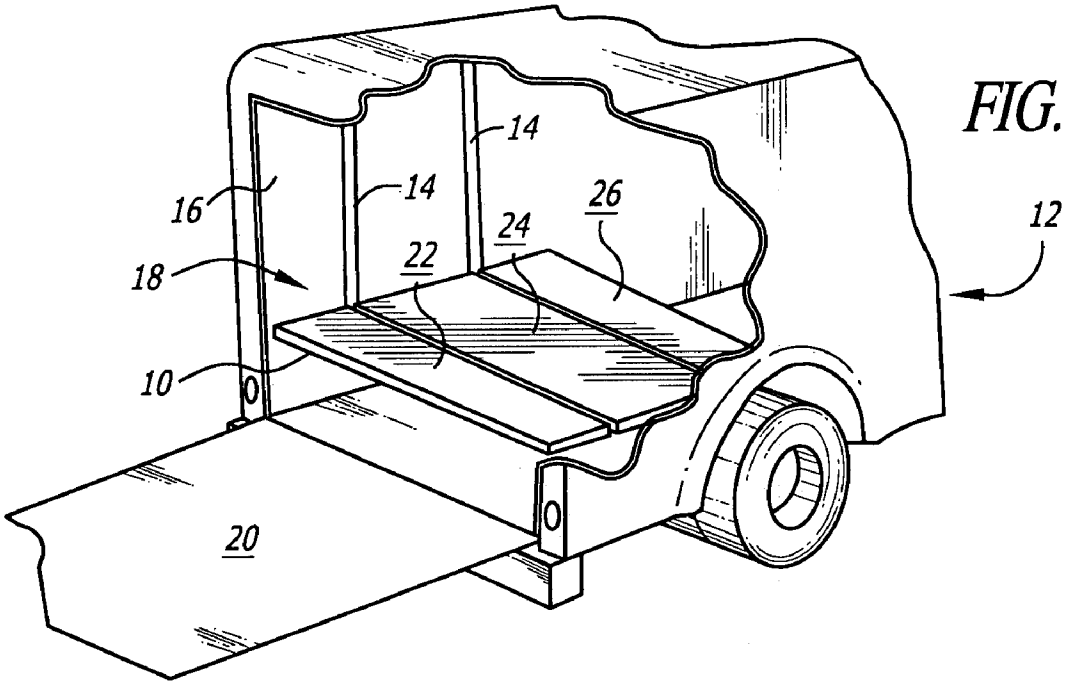
FIG. 1 is a diagrammatic right side perspective view showing a first exemplary embodiment of the folding multimodal sofa bed of the invention in its seating mode mounted to an inside wall of a recreational vehicle.

Turning first to FIG. 1, there is shown a diagrammatic right side perspective view showing a first exemplary embodiment of the folding multimodal sofa bed 10 in its bed mode that is mounted inside of a recreational vehicle 12. One method of mounting the folding multimodal sofa bed 10 is to retain it on side rails 14 mounted to the inside of side walls 16 of the RV 12. As used herein the term "recreational vehicle" or "RV" shall refer both to trailers hauled by vehicles as well as to vehicles with self-contained amenities such as beds, couches, cabinets, etc. Also, while the folding multimodal sofa bed 10 is shown as being mounted near an opened rear area 18 of an RV having a ramp 20 which can be positioned to open the rear area of the RV, the multimodal sofa bed 10 can be used with other styles of RV, including those that do not have an openable rear area 18. The multimodal sofa bed 10 has rear facing backrest section 22, an intermediate section 24 and a front facing backrest section 26. As used herein, the term "rearwardly facing" means the position a user will face while sitting on the multimodal sofa bed 10 looking backwardly outside of the RV, and the term "frontwardly facing" means the position a user will face while sitting on the multimodal sofa bed 10 looking frontwardly into the inside of the RV.

Figure 2:
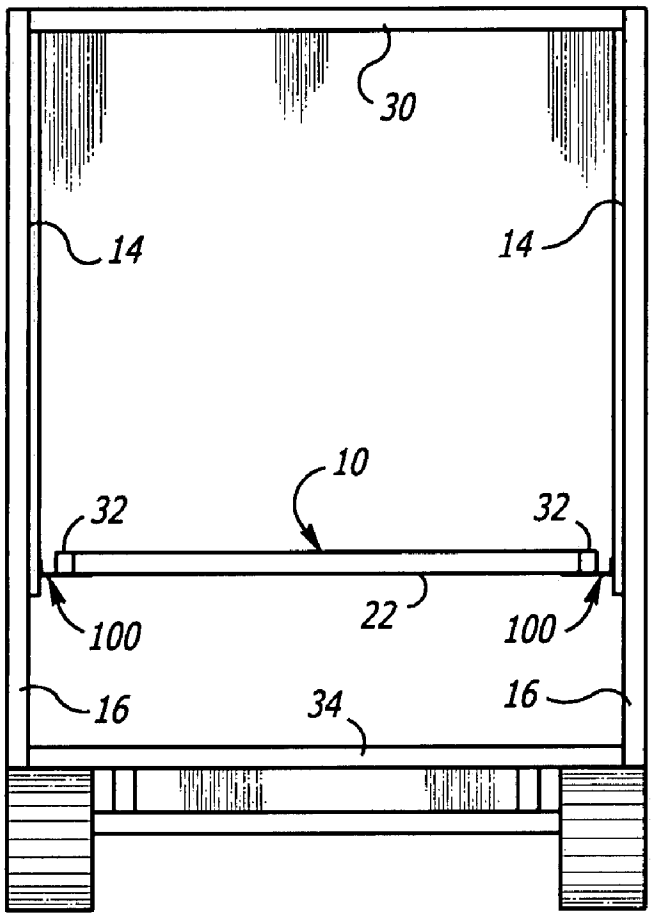
FIG. 2 is a view looking into an RV equipped with the first exemplary embodiment of the folding multimodal sofa bed of the invention in its seating mode, and in a lowered position relative to the ceiling of the RV.
Figure 3:
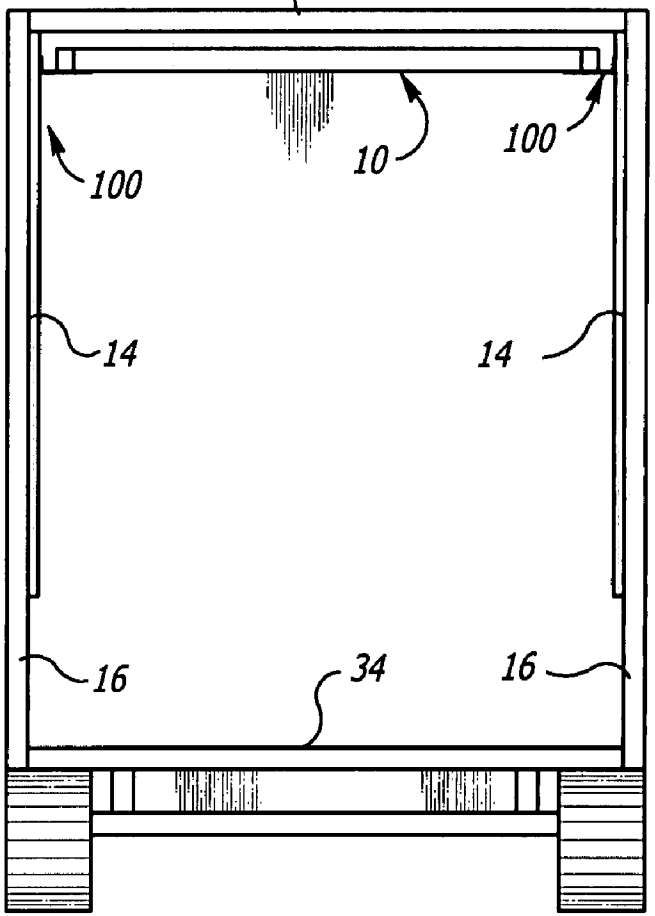
FIG. 3 is a view looking into an RV equipped with the first exemplary embodiment of the folding multimodal sofa bed of FIG. 2 and in its raised position relative to the ceiling of the RV.

FIG. 2 is a view looking into an RV equipped with the first exemplary embodiment of the folding multimodal sofa bed 10 of the invention of FIG. 1 in its seating mode, and in a lowered position relative to a ceiling 30 of the RV 12. The side rails 14 are shown mounted to the inside of side walls 16 of the RV 12. The folding multimodal sofa bed 10 has a mounting bracket unit 100 on each side connected to lateral sides 33 of the folding multimodal sofa bed 10 which connect to the side rails 14. In its lowered position, the folding multimodal sofa bed 10 is closer to the floor 34. The mounting bracket units 100 are explained in greater detail below with reference to FIG. 10. FIG. 3 is similar to FIG. 2, but shows the folding multimodal sofa bed 10 raised close to the RV's ceiling 30. Although not shown, the side rails 14 form part of a lifting and lower mechanism of the RV that is adapted to the folding multimodal sofa bed 10 be raise close to the ceiling when not in use, and then lowered when in use. The folding multimodal sofa bed 10 can be mounted in other manners.

Figure 4:
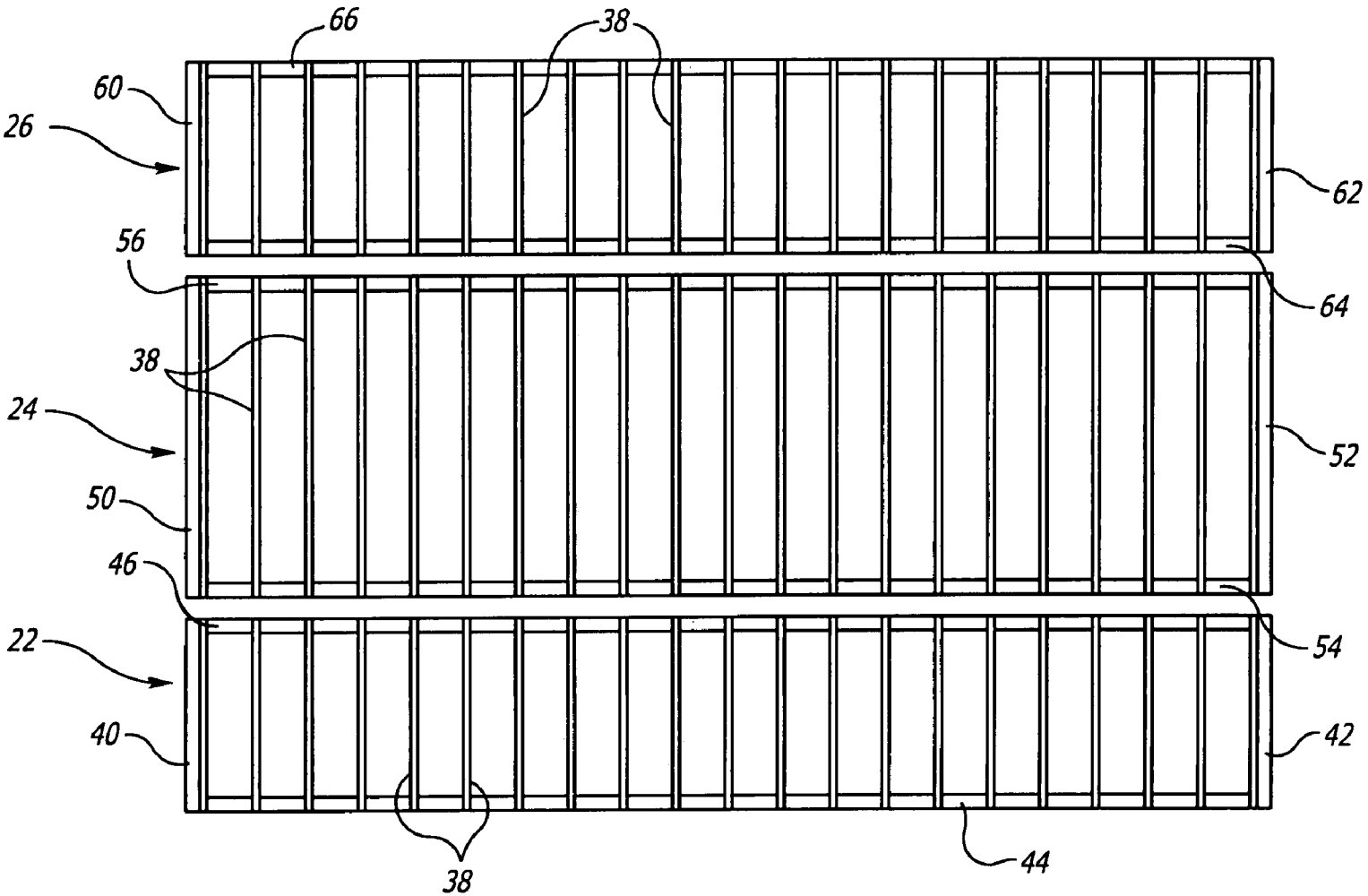
FIG. 4 is a top plan view showing a framework of the exemplary multimodal sofa bed with its connecting brackets and foldover arms not shown.

FIG. 4 is a top plan view showing a framework of the exemplary multimodal sofa bed 10 with its connecting brackets and foldover arms not shown. The multimodal sofa bed 10 has a rear facing backrest section 22, an intermediate section 24 and a front facing backrest section 26 which are joined together by foldover arms (not shown.) In the exemplary embodiment, each section is constructed as rectangular assemblages of tubing with suspension straps 38 which support upholstery which while overlay the sections. Additional braces and straps can be used to stiffen and strength each section. Other suspension structures (e.g., springs, flexible sheeting, etc.) can also be used. The rear facing backrest section 22 has two side tubes 40 and 42, an outer tube 44 and an inner tube 46. The intermediate section 24 has two side tubes 50 and 52, a rear tube 54 and a front tube 56. The front facing backrest section 26 has two side tubes 60 and 62, an inner tube 64 and an outer tube 66. The outer tube 44 defines an outer edge and the inner tube 46 defines an inner edge of the rear facing section 22, the rear tube 54 defines rear facing edge and the front tube 56 defines a front facing edge of the intermediate section 24, and the outer tube 66 defines an outer edge and the inner tube 64 defines an inner edge of the front facing section 26. When these sections are upholstered, as shown in FIG. 5, the various edges will preferably be in close relationship to each other to form a continuous and smooth surface for user comfort.

Figure 5:
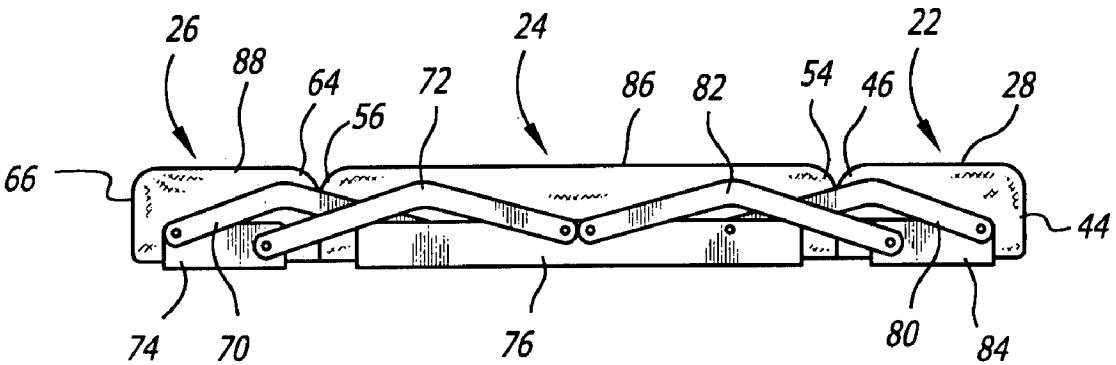
FIG. 5 is a left side view of the first exemplary embodiment of the folding multimodal sofa bed of the invention in its bed mode.

FIG. 5 is a left side view of the first exemplary embodiment of the folding multimodal sofa bed 10 of the invention in its bed mode. For simplicity of presentation, the same reference numbers used to describe tubes making up the sections of the folding multimodal sofa bed 10 are also used to describe the various edges of the sections 22, 24 and 26 as these correspond. The front facing backrest section 26 and intermediate section 24 are joined together by a front set of foldover arms, which comprise a front leading arm 70 and a front trailing arm 72. The front leading arm 70 and the front trailing arm 72 hold a front mounting bracket 74, which is connected to the front facing backrest section 26 (e.g., to side tube 40), adjacent to a center mounting bracket 76, which is connected to the intermediate section 24 (e.g. to side tube 50.) In a like manner, the rear facing backrest section 22 and intermediate section 24 are joined together by a front set of foldover arms, which comprise a rear leading arm 80 and a rear trailing arm 82. The rear leading arm 80 and the rear trailing arm 82 pivotally mount together a rear mounting bracket 84, which is connected to the rear facing backrest section 22 (e.g., to side tube 40), and the center mounting bracket 76, which is connected to the intermediate section 24. When held together in the bed mode, all sections 22, 24 and 26 remain in a flat, horizontal orientation, with the inner edge 46 of rear facing backrest section 22 adjacent to the rear edge 54 of intermediate section 24, and with the inner edge 64 of front facing backrest section 26 adjacent to the front edge 56 of intermediate section 24. The rear facing backrest section 22 has a contact surface 28, the intermediate section 24 has a contact surface 86, and the front facing backrest section 26 has a contact surface 88. In use as a bed, users will make contact with the contact surfaces 28, 86 an 88, which are normally upholstered. The sets of foldover arms 70, 72 and 80, 82 are bent to accomplish a rollover function, as will be described further below. Although not shown, a set of foldover arms are positioned on a right side of the folding multimodal sofa bed 10, which are a mirror image of the foldover arms 70, 72 and 80, 82 shown in FIGS. 5–9.

Figure 6:
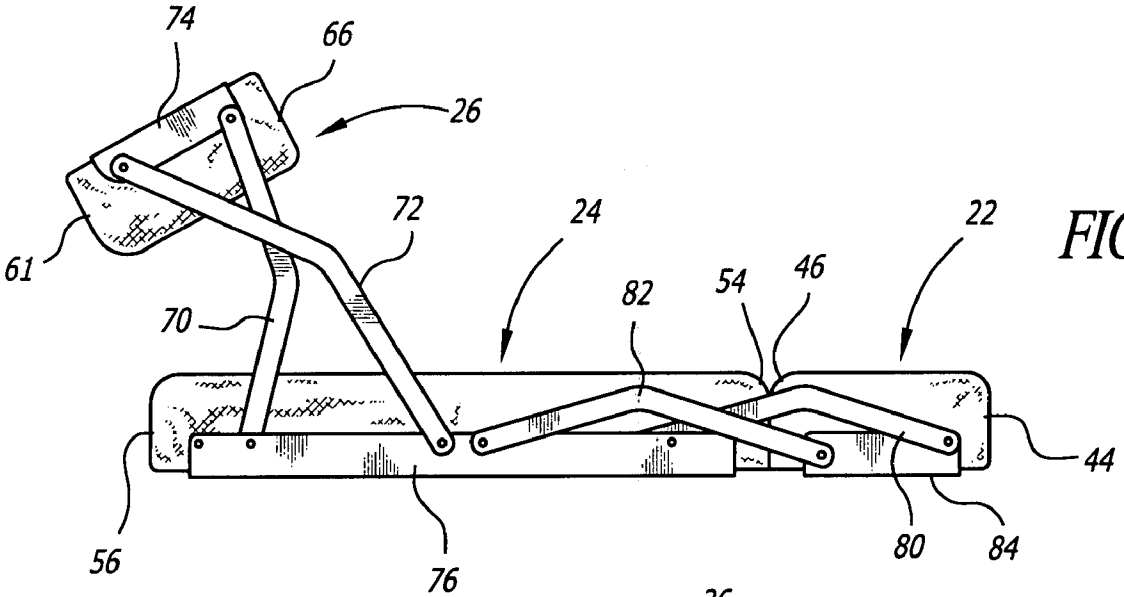
FIG. 6 is a left side view of the folding multimodal sofa bed of FIG. 5 with a front facing backrest section being lifted up and tumbled as a step to converting the bed mode of FIG. 5 to its front facing seating mode.
Figure 7:
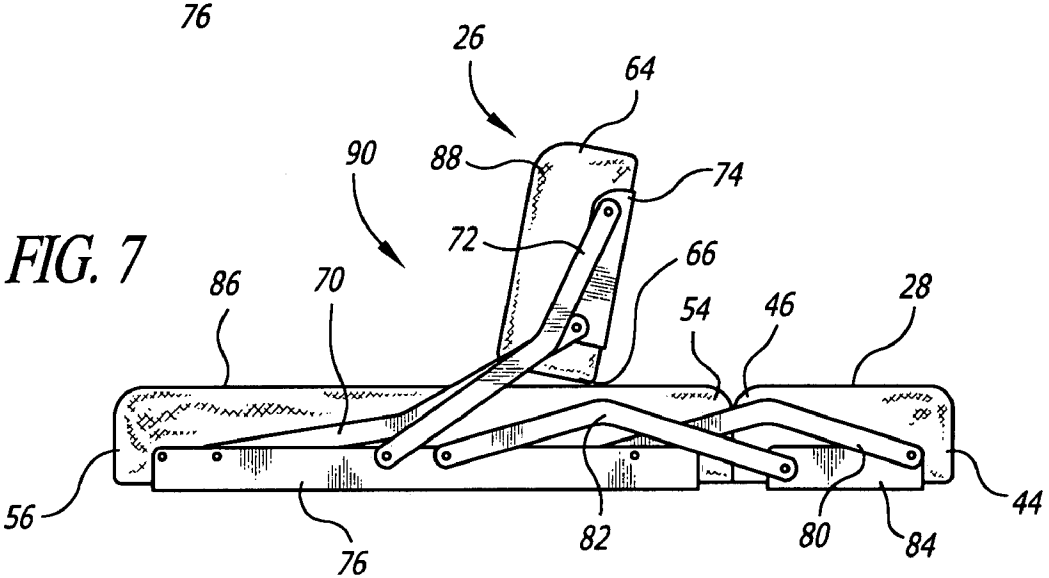
FIG. 7 is a side view showing the folding multimodal sofa bed of FIG. 5 with a front facing backrest section in position to define a front facing seating mode.

FIG. 6 is a side view of the folding multimodal sofa bed 10 of FIG. 5 with a front facing backrest section 26 being lifted up and tumbled as a step to converting the bed mode of FIG. 5 to its front facing seating mode, which is shown in its final backrest, sofa position in FIG. 7. In the process of pivoting back the front facing seatback section 26, the shape and pivot positions of the foldover arms 70, 72 ensure that the front facing seatback section 26 lies in the proper position with respect to the intermediate portion 24 to form a sofa configuration that permits a user to sit comfortably facing forwardly into the RV. In the sofa orientation, the outer edge 66 of front facing seatback section 26 will be located facing down adjacent to contact surface 88 of intermediate portion 24, and inner edge 64 of front facing seatback section 26 will be facing up and will define an upper edge of front facing seatback portion. A frontwardly facing sofa seating area 90 will thus be defined by the area of intermediate portion 24 above its contact surface 86 and forward of the contact surface 88 of front facing seatback section 26. There will remain a portion of intermediate portion 24 and rearwardly facing seatback section 22 which remain horizontal and available for use if desired.

Figure 8:
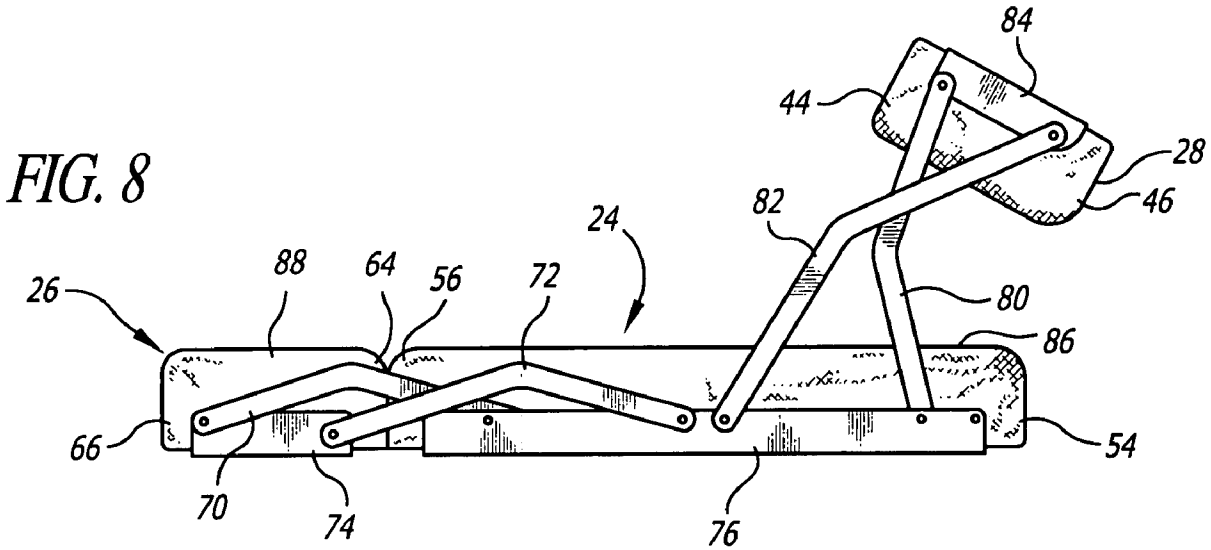
FIG. 8 is a left side view of the folding multimodal sofa bed of FIG. 5 with a rear facing backrest section being lifted up and tumbled as a step to converting the bed mode of FIG. 5 to its rear facing seating mode.
Figure 9:
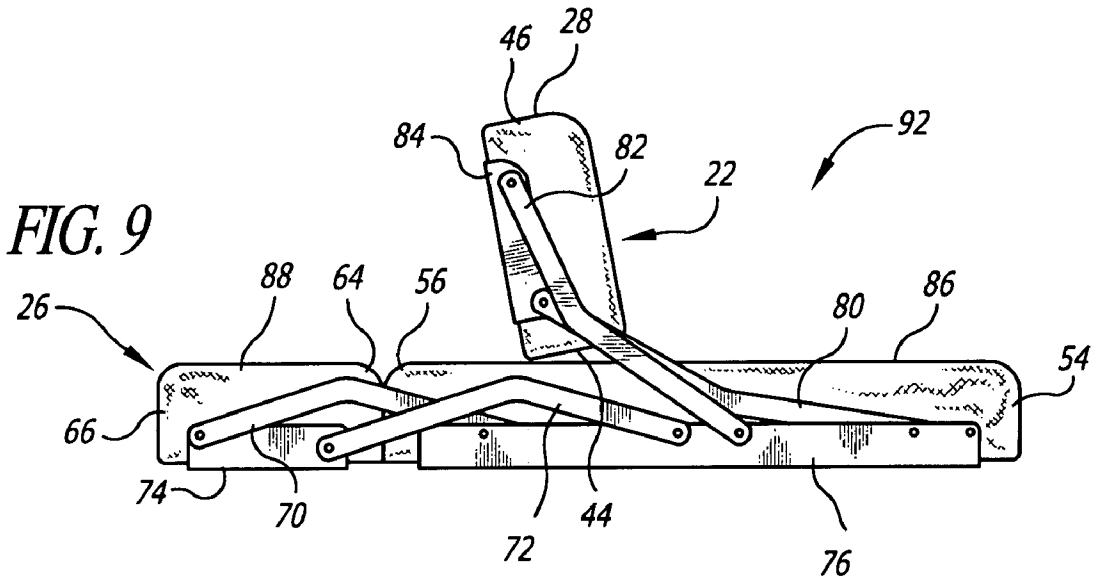
FIG. 9 is a side view showing the folding multimodal sofa bed of FIG. 5 with a rear facing backrest section in position to define a rear facing seating mode.

FIG. 8 is a side view of the folding multimodal sofa bed 10 with the rear facing backrest section 22 being lifted up and tumbled as a step to converting the bed mode of FIG. 5 to its rear facing sofa seating mode, which shown in FIG. 9. In the process of pivoting back the rear facing seatback section 22, the shape and pivot positions of the foldover arms 80, 82 ensure that the rear facing seatback section 22 lies in the proper position with respect to the intermediate portion 24 to form a sofa configuration that permits a user to sit comfortably facing rearwardly out of the RV. In the sofa orientation, the outer edge 44 of rear facing seatback section 26 will be located facing down adjacent to contact surface 88 of intermediate portion 24, and inner edge 46 of rear facing seatback section 26 will be facing up and will define an upper edge of rear facing seatback portion 26. A rearwardly facing sofa seating area 92 will thus be defined by the area of intermediate portion 24 above its contact surface 86 and forward of the contact surface 28 of rear facing seatback section 22. There will remain a portion of intermediate portion 24 and frontwardly facing seatback section 26 which are horizontal and available for use if desired.

Figure 10:
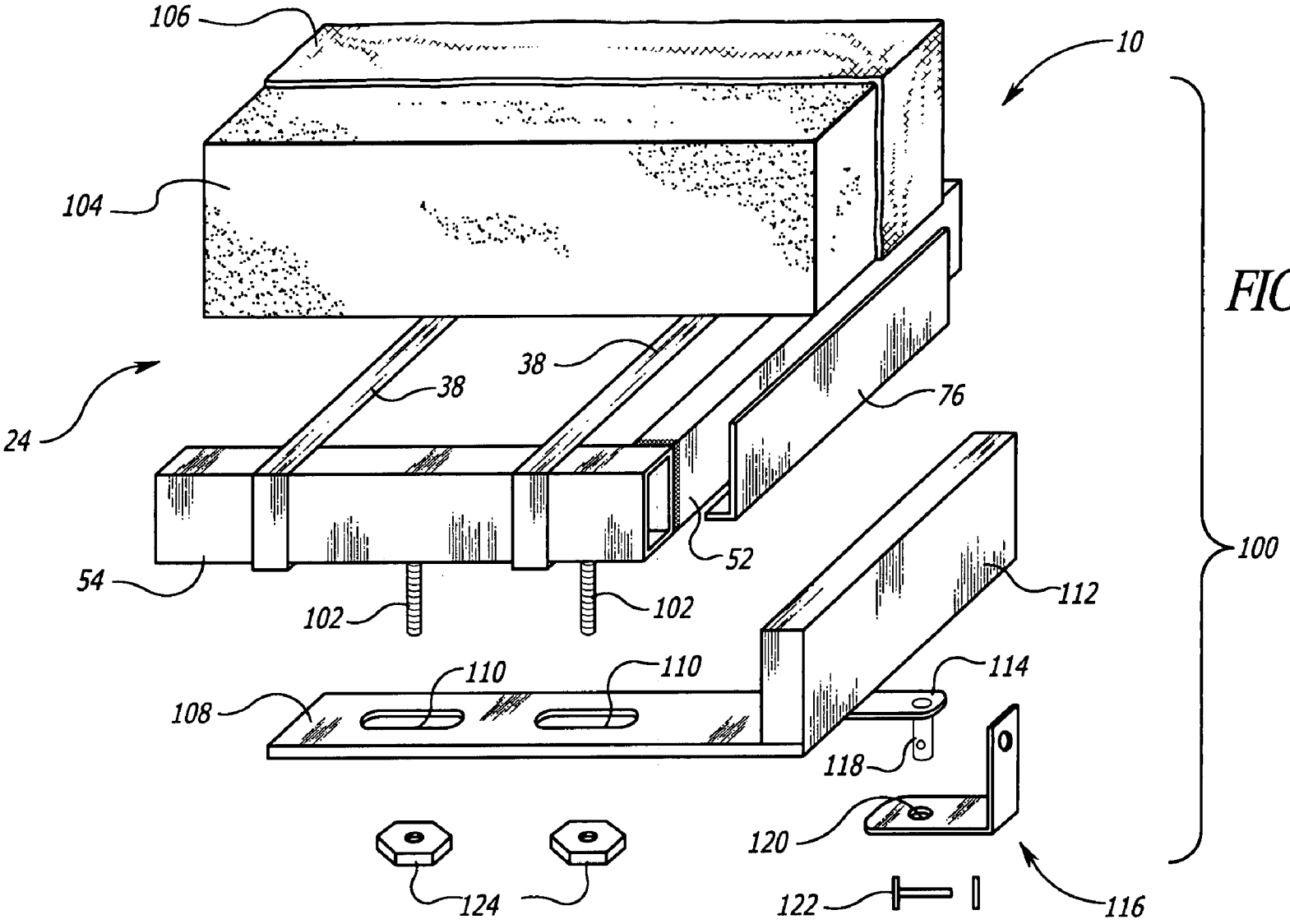
FIG. 10 is a partially cut-away perspective detail view showing a bracket unit for retaining the folding multimodal sofa bed to a suspension system.

FIG. 10 is a partially cut-away perspective detail view showing an exemplary suspension bracket unit 100 which is to be attached to the intermediate section 24 of the multimodal sofa bed 10 to a suspension system. The suspension bracket unit 100 permits the multimodal sofa bed 10 to be affixed to a bed/sofa raising and lowering mechanism, of which the rails 14 of FIGS. 1–3 form a part of. The suspension bracket unit 100, however, permits the multimodal sofa bed 10 to be affixed to other suspension mechanisms and systems. For example, the multimodal sofa bed 10 can be carried by one side wall of the RV, and dropped down for use. In such cases, supports (e.g., legs) can be provided to support the multimodal sofa bed 10, or an unpivoted or hinged side of the bed can be supported by a bracket or stop on an opposite side wall of the RV (not shown.) Attachments, such as threaded bolts 102 extended from the bottom of intermediate section 24 (e.g., from rear rail 54) can be conveniently used to attach the suspension bracket unit 100 to the intermediate section 24. FIG. 10 also shows how padding, such as foam 104 will be carried on the straps 38 and tubing 54 and 52, etc. A covering material 106 will enclose the foam 104. The center mounting bracket 76 is shown attached to the intermediate portion 24. The suspension bracket unit 100 has a plate 108 with mounting slots 110 formed therein. The plate 108 is attached to a carriage tube 112, to which is mounted a support engagement 114. The support engagement 114 is affixable to a bracket 116 affixed to the bed/soft lift mechanism (not shown.) The support engagement 114 is shown as having an engagement peg 118 which passes through an opening 120 in bracket 116. A clevis pin 122, for example, can be used to retain the bracket 116 to the support engagement. The slots 110 are provided to permit the lateral position of the bracket unit 110 to be shifted to accommodate different width requirement for RVs. RVs vary in width, with typical inside widths being from 92" to 98". Nuts 124 which screw onto the bolts 102 are used to secure the plate 108 to the intermediate portion. In lieu of having bolts 102 extending from the bottom of tubing 54, the tubing can be threaded (or have nuts welded thereto) to received bolts that will extend upwardly through the slots 110. Other methods can be used to adjustable retain the suspension bracket unit 100 to the intermediate sections.

Although embodiments of the present invention have been described in detail hereinabove in connection with certain exemplary embodiments, it should be understood that the invention is not limited to the disclosed exemplary embodiments, but, on the contrary is intended to cover various modifications and/or equivalent arrangements included within the spirit and scope of the present invention, as defined in the appended claims.

What is claimed is:

1. A folding multimodal sofa bed for use with recreational vehicles, the folding furniture comprising:

a front facing backrest section with an inner edge, an outer edge, left and right side edges and a top surface, an intermediate section with a front edge, a rear edge, left and right side edges and a top surface, and a rear facing backrest section with an inner edge, an outer edge, left and right side edges and a top surface; and a front pair of rollover arms connecting the front facing backrest section to the intermediate section, and rear pair of rollover arms connecting the rear facing backrest section to the intermediate section, wherein each pair of rollover arms comprises two non-straight arm portions, and wherein the front pair of rollover arms are adapted to permit rollover of the front facing backrest section from a horizontal bed mode, wherein the inner edge of the front facing section is adjacent to the front edge of the intermediate section, to a front facing sofa mode, wherein the outer edge of the front facing section will be adjacent to the top surface of the intermediate section and the inner edge of the front facing section will face upwardly, and wherein the rear pair of rollover arms are adapted to permit rollover of the rear facing backrest section from its horizontal bed mode, wherein the inner edge of the rear facing section is adjacent to the rear edge of the intermediate section, to a rear facing sofa mode, wherein the outer edge of the rear facing section will be adjacent to the top surface of the intermediate section and the inner edge of the rear facing section will face upwardly.

2. The folding multimodal sofa bed of claim 1, wherein the front pair of rollover arms comprise two pairs of front rollover arms that are connected to brackets attached to the left and right sides of the front facing backrest section and brackets attached to the left and right sides of the intermediate section, and wherein the rear pair of rollover arms comprise two pairs of rear rollover arms that are connected to brackets attached to the left and right sides of the rear facing backrest section and connected to the brackets connected to the left and right sides of the intermediate section.

3. The folding multimodal sofa bed of claim 1, further comprising a suspension bracket unit for raising and lower the multimodal sofa bed.

4. The folding multimodal sofa bed of claim 1, wherein the suspension bracket unit is attached to the intermediate section and comprises a width adjustment plate and a support engagement, wherein the width adjustment plate is adjustable laterally outwardly from the sides of the intermediate section.

5. The folding multimodal sofa bed of claim 1, wherein the front facing backrest section, the intermediate section, and the rear facing backrest section seating comprises framework sections having a plurality of straps are secured around the framework that are upholstered.

6. A folding multimodal sofa bed for use with recreational vehicles, the folding furniture comprising:

a front facing backrest section, an intermediate section, and a rear facing backrest section; and a front pair of rollover arms connecting the front facing backrest section to the intermediate section, and rear pair of rollover arms connecting the rear facing backrest section to the intermediate section, wherein each pair of rollover arms comprises two non-straight arm portions, and wherein the front pair of rollover arms are adapted to permit rollover of the front facing backrest section from a horizontal bed mode, wherein the front facing backrest section is oriented in a horizontal position and is adjacent to the intermediate section which is oriented in a horizontal orientation and the rear facing section is oriented in a horizontal position and is adjacent to the horizontal intermediate section, to a front facing sofa mode, wherein the front facing backrest section is pivoted to be above the top surface of the horizontal intermediate section in a generally vertical, slanted back orientation facing forward, and wherein the rear pair of rollover arms are adapted to permit rollover of the rear facing backrest section from the horizontal bed mode, to a rear facing sofa mode, wherein the rear facing backrest section is pivoted to be above the top surface of the intermediate section in a generally vertical, slanted back orientation facing rearwardly.

7. The folding multimodal sofa bed of claim 6, wherein the front pair of rollover arms comprise two pairs of front rollover arms that are connected to brackets attached to the left and right sides of the front facing backrest section and brackets attached to the left and right sides of the intermediate section, and wherein the rear pair of rollover arms comprise two pairs of rear rollover arms that are connected to brackets attached to the left and right sides of the rear facing backrest section and connected to the brackets connected to the left and right sides of the intermediate section.

8. The folding multimodal sofa bed of claim 6, further comprising a suspension bracket unit for raising and lower the multimodal sofa bed.

9. The folding multimodal sofa bed of claim 6, wherein the suspension bracket unit is attached to the intermediate section and comprises a width adjustment plate and a support engagement, wherein the width adjustment plate is adjustable laterally outwardly from the sides of the intermediate section.

10. The folding multimodal sofa bed of claim 6, wherein the front facing backrest section, the intermediate section, and the rear facing backrest section seating comprises framework sections having a plurality of straps are secured around the framework that are upholstered.

* * * * *